United States Patent [19]

Bocanegra Marquina

[11] 4,060,115

[45] Nov. 29, 1977

[54] HANDLE FOR HAND TOOLS TO BE ROTATED DURING OPERATION

[76] Inventor: Jesus Bocanegra Marquina, Burgos, Avda. Reyes, Catolicos, Edificio, Nebrija, Spain

[21] Appl. No.: 761,623

[22] Filed: Jan. 24, 1977

[30] Foreign Application Priority Data

Jan. 23, 1976 Spain ..... 218263

[51] Int. Cl.[2] ..... B25G 1/00

[52] U.S. Cl. ..... 145/61 G

[58] Field of Search ..... 145/61 R, 61 E, 61 EA, 145/61 G, 61 K; 81/177 D

[56] References Cited

FOREIGN PATENT DOCUMENTS 3,331 of 1870 United Kingdom ..... 145/61 G

*Primary Examiner*—James L. Jones, Jr.

*Attorney, Agent, or Firm*—Imirie, Smiley & Guay

[57] ABSTRACT

A handle for hand tools that must be rotated during operation such as screw drivers, wrenches or the like comprises a T-shaped member including a central beam portion and a prependicular cross-bar portion. The central beam portion comprises a sleeve structure having an axially disposed blind bore adapted to receive and to be rigidly fixed to the shank of a tool at the end opposite the tool end, and the cross-beam portion comprises a handle for turning the tool. The beam portion has a shoulder adjacent the cross-bar handle portion and a bead at its lower end with a smooth generally cylindrical or slightly conical bearing surface intermediate thereof, and a sleeve is fitted around the general cylindrical surface for rotatable movement of the bearing surface during operation of the tool so that the tool can be firmly grasped and held securely in correct position by one hand of the operator grasping the sleeve while the operator uses the cross-bar handle with the other hand to rotate the handle and the tool.

7 Claims, 5 Drawing Figures

FIG. 1
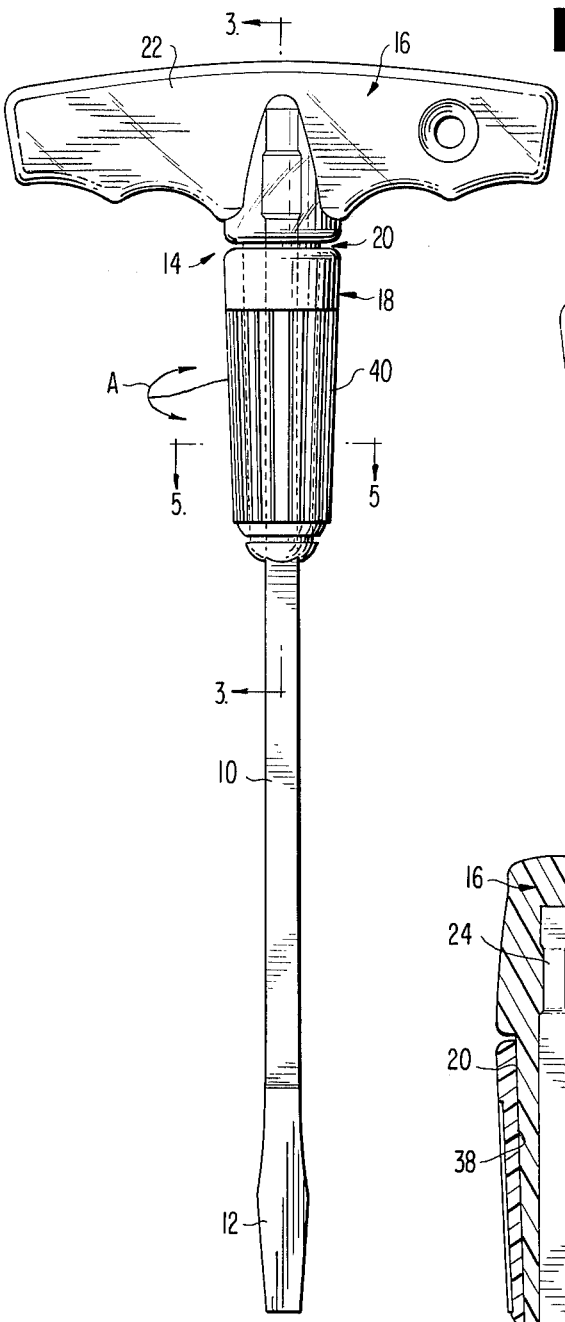
FIG. 2
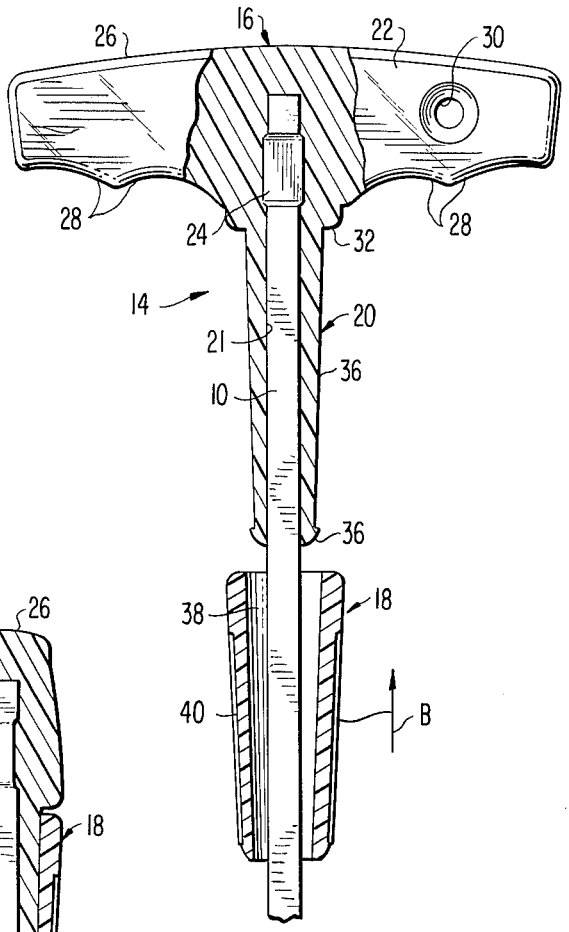
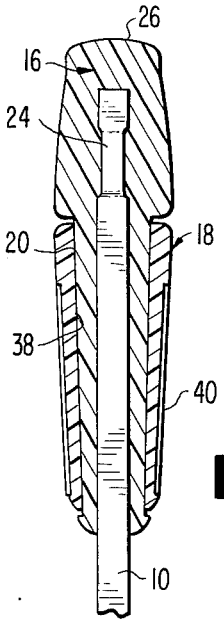
FIG. 3
FIG. 4
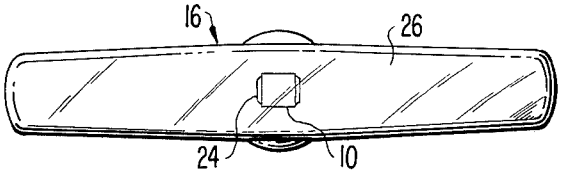
FIG. 5
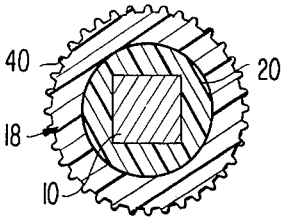

HANDLE FOR HAND TOOLS TO BE ROTATED DURING OPERATION

BACKGROUND OF THE INVENTION

Hand tools of the type such as screw drivers, wrenches and the like that are adapted to be rotated during the operation of the tool and which have a shank portion extending from the tool end to a handle, usually have the handle adjacent the opposite end of the shank portion from the tool end and this handle comprises an enlargement around and longitudinally of the shank to facilitate gripping the tool. The axial relation of the tool handle to the tool shank does cause problems, however, because the tool must not only be held rigidly by the handle, but also turned by means of the handle and as a result, the tool is apt to wobble and this can result in difficulty of operation and even in damaging the element or member, such as a screw, nut or bolt, or the like, which is to be operated by the tool.

SUMMARY OF THE INVENTION

The present invention resides in a tool handle comprising a T-shaped member of which the beam portion constitutes a sleeve for fitting over the free end of a tool shank and to be rigidly fixed therewith, and a cross-bar section constituting a handle to be grasped for turning the tool. The beam portion has a bead at its free end and a bearing shoulder immediately adjacent the cross-handle with a cylindrical or slightly conical, hereinafter defined as generally cylindrical, smooth surface bearing portion therebetween, and a sleeve having a generally smooth inner surface conforming to said bearing portion is revolvably mounted on the general cylindrical bearing portion and preferably has on its outer surfaces ridges, splines or other configurations that enable a firm grip of the sleeve. Thus, in operation, the operator can grasp the sleeve in one hand to hold the tool firmly in alignment with the element on which it is to be operated, and turn the tool by means of the cross-bar to actuate the member on which the tool is to be operated. Thus, the threading of a screw or a nut on a bolt or the like is greatly facilitated.

BRIEF DESCRIPTION OF THE DRAWING

FIG. 1 is a view in elevation of a tool, specifically a screw driver, having a handle in accordance with the present invention;

FIG. 2 is an exploded view partially in section through the handle assembly;

FIG. 3 is a cross-sectional view taken on line 3—3 of FIG. 1;

FIG. 4 is a plan view of the handle end and cross-bar of the tool handle, and FIG. 5 is an enlarged cross-sectional view taken on line 5—5 of FIG. 1.

DETAILED DESCRIPTION OF THE DRAWING

The present invention resides in the handle for any tool of the type having a shank portion which is to be rotated about the axis of the shank portion during operation of the tool. Specifically, as shown in FIG. 1, the tool can comprise a screw driver but also is equally applicable to wrenches of some types, particularly socket wrenches, and other types of tools requiring a rotary motion about the axis of the tool shank in operation. More specifically as shown in FIG. 1, the tool is illustrated as a screw driver comprising a shank portion

10 having a screw driver bit 12 at one end and a handle structure 14 in accordance with the present invention at the other end of such shank portion.

The handle portion 14 comprises a T-shaped member 16 and a sleeve 18, the member 16 including a central beam 20 of sleeve configuration and having a blind bore for fitting over and to be secured to the shank 10, and a cross-bar 22 at the free end of the beam portion 20 to be grasped to turn the handle. The T-shaped member 16 may be composed of any type of material, such as wood, but more conveniently according to the present invention, it is constructed of a material that may be moulded or cast, preferably of aluminum or a synthetic plastic material, on the shank 10 and the shank may have a configuration, such as a square cross-section, as shown in FIG. 5 and/or be provided with a deformation 24 as shown in FIGS. 2 and 3 that will securely lock the shank element within the handle 16 against both longitudinal and rotary relative movement.

The cross-bar 22 may have a smooth slightly curved free edge 26 for engagement with the palm of the hand of the operator and the opposite edge portion thereof may have curved recesses 28 for engagement by the fingers of the operator and in one branch of the cross-bar 22 there may be a hole 30 for receiving a lever to facilitate operation of the tool, and by which the tool may be suspended on a hook or the like when not in use. At the juncture of the beam portion 20 with the cross-bar portion 22, an external should 32 provides an end bearing surface and at the free end of the beam portion 20, there is a bead 34 and between the bearing portion 32 and bead 34, there is a smooth surface generally cylindrical or very slightly conical bearing surface 36 about which the sleeve 18 is fitted for relative revolving or pivotal movement as indicated by the arrow A in FIG. 1.

The portion 36 preferably is slightly conical and as the sleeve 18 conforms thereto, the end of the sleeve engaging with the bearing shoulder 32 is of a slightly greater diameter and can more readily be pushed over the bead 34 when it is assembled on the portion 36, the opening at the opposite end of the sleeve 18 being slightly smaller so that it can be trapped by the bead 34 to retain the sleeve 18 on the bearing surface. The inner surface 38 of the sleeve 18 is smooth and conforms to the bearing surface to enable ready rotation therebetween while the outer surface of the sleeve 18 is provided with longitudinally extending ribs 40 or other rough surface configuration to facilitate a firm grasp by the operator. The sleeve 18 may be composed of a material having a slight elastic characteristic to facilitate pressing in the direction of the arrow B in FIG. 2, to force the bead over the bead 34.

In operation, the tool bit end 12, whether it be a screw driver bit, a wrench or other type of device, is fitted to the element to be turned and the sleeve 18 is grasped in one hand by the operator to hold the tool firmly in axial position and prevent wobbling of the tool while the cross-bar 22 is grasped by the operator's other hand and turned while also pressed against the member operated upon and in this way, the tool is rigidly retained in position while the tool is turned. Thus, there is little if any wobbling of the tool and no damage to the tool engaging portions of the element which is operated by the tool.

What is claimed is:

1. A handle for hand tools including a shank with a tool element at one end and that must be rotated about an axis longitudinal of the shank during operation, comprising a T-shaped member including a central beam portion and a perpendicular cross-bar portion at one end of the beam portion, said central beam portion being constituted by a sleeve structure having an axially disposed blind bore adapted to receive and be rigidly fixed to a tool shank at the end opposite the tool end thereof, and the cross-beam portion constituting a handle for turning the tool, said beam portion having a smooth generally cylindrical bearing surface intermediate thereof with a bead at its free end, and a sleeve fitted around the generally cylindrical surface and retained by said bead for rotatable movement of the bearing surface during operation of the tool so that the tool can be firmly grasped and held securely in correct position by one hand of the operator grasping the sleeve while the operator uses the cross-bar handle with the other hand to rotate the handle and the tool.

2. A tool handle according to claim 1 wherein said sleeve has a smooth generally cylindrical inner surface conforming to but freely slidable rotatively on said bearing surface, the outer surface of said sleeve being rough to facilitate a firm grip by an operator.

3. A tool handle according to claim 2 wherein said T-shaped member comprises a shoulder at the juncture of said beam and cross-bar portions and at the opposite end from said bead of said bearing surface and constituting an end bearing surface for said sleeve.

4. A tool handle according to claim 3 wherein said cross-bar portion has a slightly curved smooth outer surface for engagement with the palm of an operator's hand and an inner surface having a plurality of curved recesses for accommodating the operator's fingers.

5. A tool handle according to claim 4 wherein said cross-bar portion has a hole opening through its sides for receiving a lever to assist in turning the handle.

6. A tool handle according to claim 3, in combination with a tool shank having a non-cylindrical configuration, said T-shaped member comprising a moldable material that is molded directly on said shank.

7. A tool handle according to claim 3 wherein said sleeve comprises a material having slight elastic characteristics to enable assembly of said sleeve over said bead onto said bearing surface.

* * * * *